US007218744B2

(12) United States Patent
Kobayashi

(10) Patent No.: US 7,218,744 B2
(45) Date of Patent: May 15, 2007

(54) PIEZO-ELECTRIC SPEAKER

(76) Inventor: Fujihiko Kobayashi, 19-12, Mitojimamotomachi, Fuji-shi, Shizuoka-ken (JP)

( * ) Notice: Subject to any disclaimer, the term of this patent is extended or adjusted under 35 U.S.C. 154(b) by 249 days.

(21) Appl. No.: 10/646,504

(22) Filed: Aug. 21, 2003

(65) Prior Publication Data

US 2004/0042628 A1 Mar. 4, 2004

(30) Foreign Application Priority Data

Aug. 28, 2002 (JP) ..... 2002-248490
Apr. 24, 2003 (JP) ..... 2003-119594

(51) Int. Cl.
*H04R 25/00* (2006.01)
*H04R 1/00* (2006.01)
*H04R 9/06* (2006.01)

(52) U.S. Cl. ..... 381/190; 381/423

(58) Field of Classification Search ..... 381/114, 381/116, 173, 190–191, 423–424; 310/322, 310/324, 334, 800, 365, 369; 181/163–165
See application file for complete search history.

(56) References Cited

U.S. PATENT DOCUMENTS 6,282,298 B1 * 8/2001 Azima et al. ..... 381/423
6,332,029 B1 * 12/2001 Azima et al. ..... 381/152
6,442,282 B2 * 8/2002 Azima et al. ..... 381/152
6,694,038 B1 * 2/2004 Azima ..... 381/423
6,795,561 B1 * 9/2004 Bank ..... 381/152
2002/0067840 A1 6/2002 Kobayashi
2003/0053645 A1 3/2003 Kobayashi

FOREIGN PATENT DOCUMENTS

| | | |
|---|---|---|
| JP | 57-089398 | 6/1982 |
| JP | 59-139800 | 8/1984 |
| JP | 60-182300 | 9/1985 |
| JP | 6-22395 | 1/1994 |
| JP | 11-027798 | 1/1999 |
| JP | 2001-160999 | 6/2001 |

* cited by examiner

*Primary Examiner*—Quoc Tran
*Assistant Examiner*—P Dabney
(74) *Attorney, Agent, or Firm*—Harness, Dickey & Pierce, P.L.C.

(57) ABSTRACT

A piezo-electric speaker capable of easily ensuring a uniform broad-band sound pressure and reproducing a large acoustic signal has a piezo-electric member (10) to generate vibration in accordance with an applied electric signal. A piezo-electric vibration plate (15) is adhered to the piezo-electric member (10). The piezo-electric vibration plate (15) converts the vibration to sound. The thickness of the piezo-electric vibration plate (15) is formed so as to be different in accordance with the distance from the vibration center of the piezo-electric member (10).

12 Claims, 7 Drawing Sheets

PIEZO-ELECTRIC SPEAKER

CROSS-REFERENCE TO RELATED APPLICATIONS

This application claims priority to Japanese Patent Application Nos. 2002-248490 filed Aug. 28, 2002 and 2003-119594 filed Apr. 24, 2003, which applications are herein expressly incorporated by reference.

FIELD OF THE INVENTION

The present invention relates to a piezo-electric speaker using a piezo-electric member.

BACKGROUND OF THE INVENITON

Prior art piezo-electric speakers have perfect circle piezo-electric members to generate a vibration in accordance with an electric signal applied to the member. Also, they include perfect circle piezo-electric vibration plates adhered to the piezo-electric member to convert the vibration to sound. The piezo-electric vibration plate has a uniform thickness and has a vibration center adapted to coincide with the center of the piezo-electric member (see Japanese Laid-open Patent Publication No. 22395/1994).

In prior art piezo-electric speakers, however, since the piezo-electric vibration plates can vibrate but are made of a metallic material with less stretchability, when sound pressure is increased, no vibrating or a spurious vibration may be generated in some parts of the piezo-electric vibration plate. This causes a distortion, such as a crease generated during vibration, so that it is difficult to ensure uniform broad-band sound pressure.

SUMMARY OF THE INVENTION

In view of the foregoing circumstances, it is an object of the present invention to provide a piezo-electric speaker capable of easily ensuring a uniform broad-band sound pressure and reproducing a large acoustic signal.

In a first preferred embodiment, a piezo-electric member for generating vibration in accordance with an applied electric signal is adhered to a piezo-electric vibration plate which converts the vibration to sound. The thickness of the piezo-electric vibration plate is changed in accordance with the distance from the vibration center of the piezo-electric member.

In a second preferred embodiment of the present invention, the thickness of the piezo-electric vibration plate is decreased in proportion to the distance from the vibration center of the piezo-electric member.

In a third preferred embodiment of the present invention, the thickness of the piezo-electric vibration plate is uniform at a periphery of a portion connected to the piezo-electric member.

In a fourth preferred embodiment of the present invention, the thickness of the piezo-electric vibration plate is smaller at a periphery of a portion connected to the piezo-electric member than that of the portion connected to the piezo-electric member.

In a fifth preferred embodiment of the present invention, the piezo-electric vibration plate is divided into several arbitrary configurations and connected by the piezo-electric member.

In a sixth preferred embodiment of the present invention, the piezo-electric member for generating vibration in accordance with an applied electric signal is adhered to the piezo-electric vibration plate which converts vibration to sound. The piezo-electric vibration plate is divided into several arbitrary configurations. The thickness of each of the piezo-electric vibration plates is different from each other.

In a seventh preferred embodiment of the present invention, an elastic member is adhered to a surface of each of the piezo-electric vibration plates on an opposite side of the piezo-electric member to provide uniformity to the thickness of each of the piezo-electric vibration plates.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will be described with reference to the accompanying drawings in which.

DETAILED DESCRIPTION OF THE PREFERRED EMBODIMENTS

The following description of the preferred embodiment(s) is merely exemplary in nature and is in no way intended to limit the invention, its application, or uses.

Figure 1:
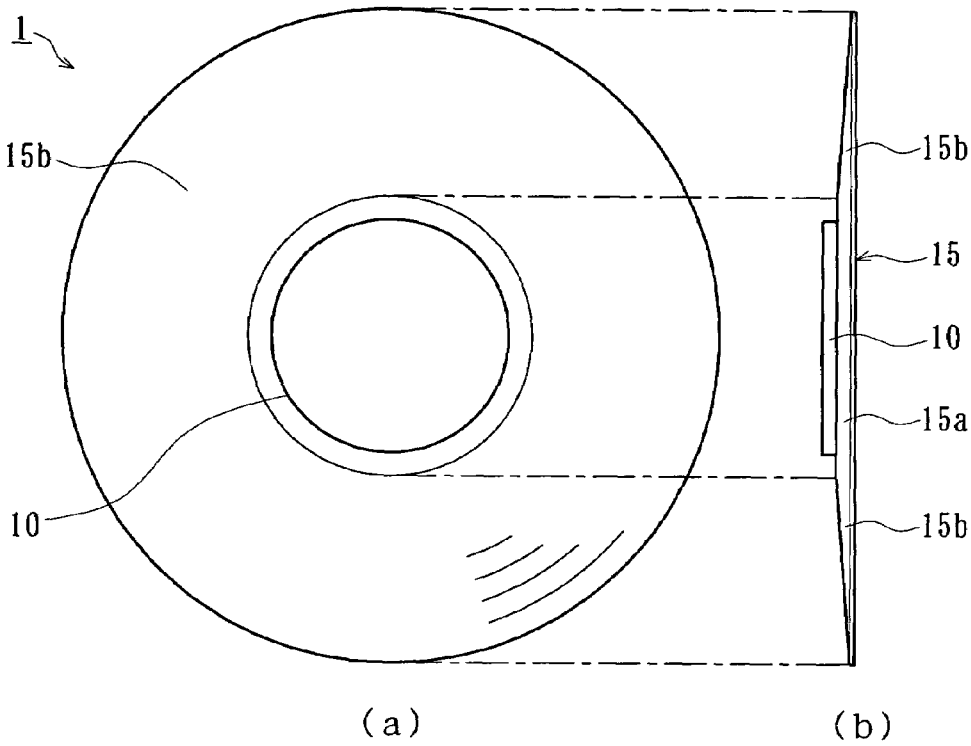
FIGS. 1(*a*) and 1(*b*) are a front view and a right side view, respectively, illustrating one preferred embodiment of a piezo-electric speaker according to the present invention.

A piezo-electric speaker 1 shown in FIGS. 1(*a*) and 1(*b*) is connected to audio instruments such as CD players or MD players for producing sound. The piezo-electric speaker 1 is constructed with a piezo-electric member 10 and a piezo-electric vibration plate 15. The piezo-electric member 10 is a disk made of piezo-electric ceramic for generating a mechanical distortion in accordance with electric signals. The piezo-electric vibration plate 15 is a metallic disk having a larger area than that of the piezo-electric member 10. Also, a central portion 15*a* of the piezo-electric vibration plate 15 has a somewhat larger area than that of the piezo-electric member 10. The central portion 15*a* is thicker than a peripheral portion 15*b* which is a peripheral region of the piezo-electric vibration plate 15. The peripheral portion 15*b* is formed such that the thickness is gradually decreased from the center of the piezo-electric vibration plate 15 toward the periphery.

The piezo-electric member 10 is adhered to the central portion 15*a* of the piezo-electric vibration plate 15 so that the piezo-electric vibration plate 15 can convert the mechanical distortion of the piezo-electric member 10 to an acoustic vibration. Incidentally, the piezo-electric vibration plate 15 is made of iron, copper, brass, stainless steel (SUS), titanium or the like as metallic material, carbon graphite or the like as carbon material, polyimide or the like as resin material, or a compound material in which boron or the like is vapor-deposited on the surface of one of the above-mentioned materials, and any other materials capable of propagating the acoustic vibration.

Figure 2:
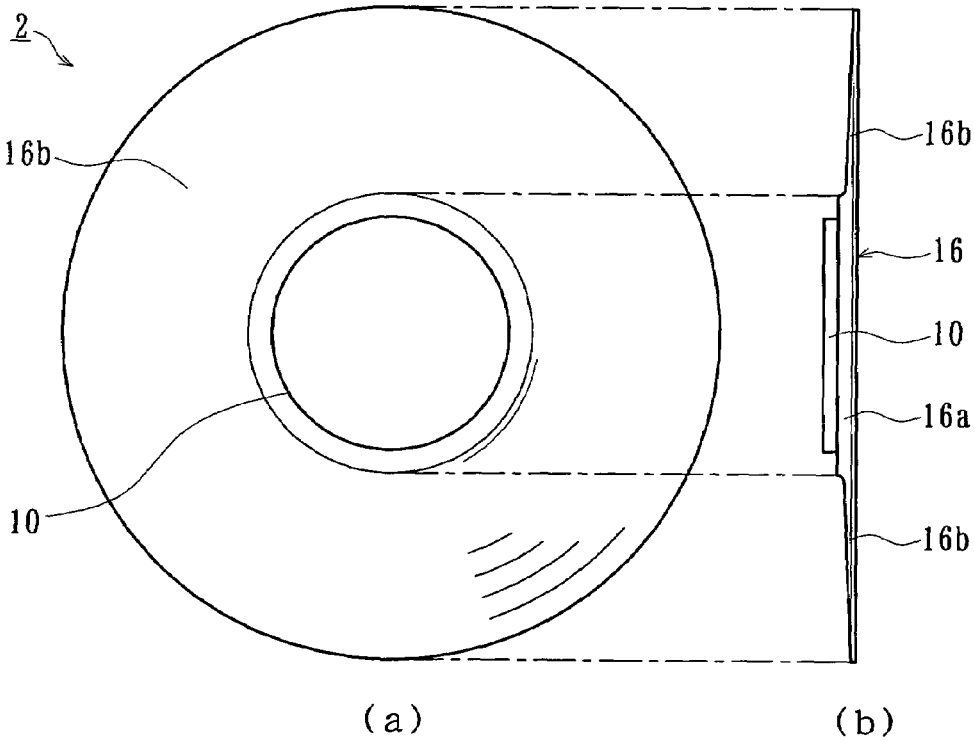
FIGS. 2(*a*) and 2(*b*) are a front view and a right side view, respectively, illustrating a second preferred embodiment of a piezo-electric speaker according to the present invention.

A piezo-electric speaker 2 of a second embodiment is shown in FIGS. 2(*a*) and 2(*b*). The speaker 2 has the same function as that of the piezo-electric speaker 1 and is constructed with a piezo-electric member 10 and a piezo-electric vibration plate 16. The piezo-electric vibration plate 16 has a metallic disk having a larger area than that of the piezo-electric member 10. Also, a central portion 16*a* of the piezo-electric vibration plate 16 has somewhat larger area than that of the piezo-electric member 10 and is thicker than a peripheral portion 16*b* which is a peripheral region of the piezo-electric vibration plate 16. The peripheral portion 16*b* is formed such that the thickness decreases from the center of the piezo-electric vibration plate 16 toward the periphery. Particularly, in the area of the peripheral portion 16*b* that is right outside of the central portion 16*a*, the thickness of the piezo-electric speaker varies as a parabolic shape. The piezo-electric vibration plate 16 is made of the same materials as that of the piezo-electric vibration plate 15.

Figure 3:
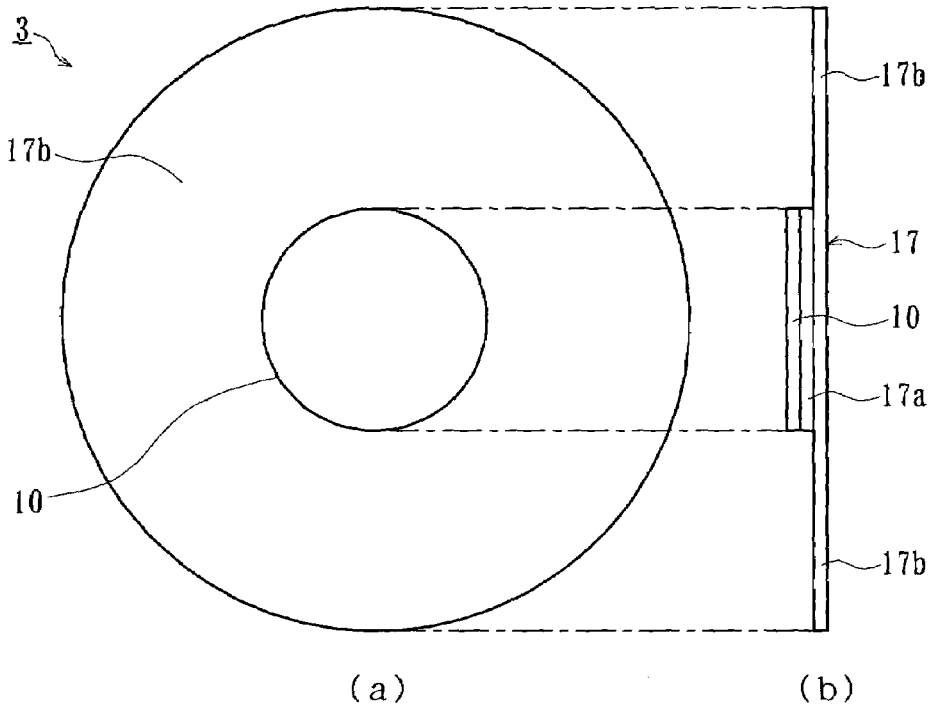
FIGS. 3(*a*) and 3(*b*) are a front view and a right side view, respectively, illustrating a third preferred embodiment of a piezo-electric speaker according to the present invention with a thickness at a central portion and at a peripheral portion different from each other.

A piezo-electric speaker 3 of a third embodiment is shown in FIGS. 3(*a*) and 3(*b*). The speaker 3 has the same function as that of the piezo-electric speaker 1. The piezo-electric speaker 3 includes the piezo-electric member 10 and a piezo-electric vibration plate 17. The piezo-electric vibration plate 17 is a metallic disk having a larger area than that of the piezo-electric member 10. Also, a central portion 17*a* of the piezo-electric vibration plate 17 has the same area as that of the piezo-electric member 10. The central portion 17*a* is thicker than a peripheral portion 17*b*. The piezo-electric member 10 is adhered to the central portion 17*a* of the piezo-electric vibration plate 17. Thus, the piezo-electric vibration plate 17 can convert the mechanical distortion of the piezo-electric member 10 to acoustic vibration. The piezo-electric vibration plate 17 is made from the same material as that of the piezo-electric vibration plate 15.

Figure 4:
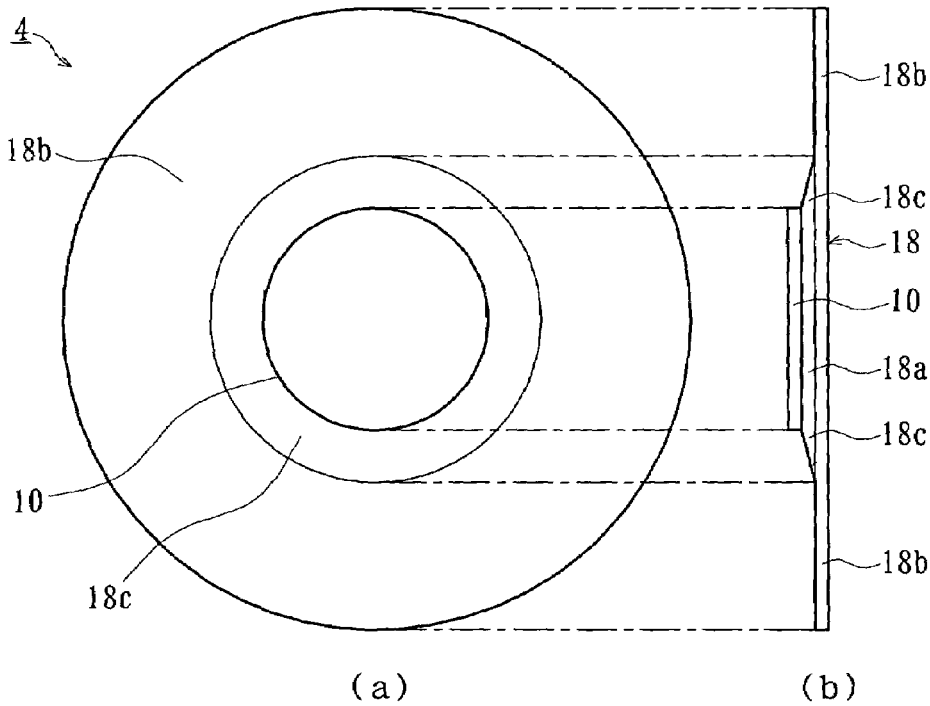
FIGS. 4(*a*) and 4(*b*) are a front view and a right side view, respectively, illustrating a fourth preferred embodiment of the piezo-electric speaker according to the present invention.

A piezo-electric speaker 4 of a fourth embodiment is shown in FIGS. 4(*a*) and 4(*b*). The speaker 4 has the same function as that of the piezo-electric speaker 1. The piezo-electric speaker 4 includes the piezo-electric member 10 and a piezo-electric vibration plate 18. The piezo-electric vibration plate 18 is a metallic disk having a larger area than that of the piezo-electric member 10. Also, a central portion 18*a* of the piezo-electric vibration plate 18 has the same area as that of the piezo-electric member 10. The central portion 18*a* is thicker than a peripheral portion 18*b*. A sloping portion 18*c* is provided between the central portion 18*a* and the peripheral portion 18*b*. The thickness of the piezo-electric vibration plate 18 is gradually decreased. The sloping portion 18*c* of the piezo-electric vibration plate 18 is shaped so that the thickness would linearly vary, however, the shape of the sloping portion 18*c* is not limited. For example, the thickness of the piezo-electric vibration plate 18 may vary in a parabolic shape provided that the thickness decreases toward the periphery of the piezo-electric vibration plate 18. The piezo-electric member 10 is adhered to the central portion 18*a* of the piezo-electric vibration plate 18. Thus, the piezo-electric vibration plate 18 can convert the mechanical distortion of the piezo-electric member 10 to acoustic vibration. The piezo-electric vibration plate 18 is made from the same material as that of the piezo-electric vibration plate 15.

The above-described piezo-electric speakers 1 to 4 are structured so that the vibration center of the piezo-electric member 10 can be situated at the center of each of the piezo-electric vibration plates 15 to 18. This propagates the vibration of the piezo-electric member 10 from the center of each of the piezo-electric vibration plates 15 to 18 to their peripheries.

In prior art piezo-electric speakers, they have a uniform thickness of the piezo-electric vibration plate. Thus, it was easy to reproduce a high-pitched sound range depending on a vibration of the central portion of the piezo-electric member. Since sound pressures decrease in a low-pitched sound range, they require a larger vibrating surface. Thus, it was difficult to reproduce the low-pitched sound range. Accordingly, in order to reproduce a broad range of sound from the high-pitched sound to the low-pitched sound, it is essential to vibrate the entire piezo-electric vibration plate. Thus, it was required to reduce the thickness of the piezo-electric vibration plate. However, when a larger signal is applied in order to raise sound pressure, the piezo-electric vibration plate generates an excess vibration, such as a second-order vibration or a third-order vibration, which deteriorates sound quality. In this case, when the thickness of the piezo-electric vibration plate was increased in order to suppress the excess vibration of the second-order vibration, third-order vibration and the like of the piezo-electric vibration plate, the piezo-electric vibration plate grew stiff. Thus, the entire piezo-electric vibration plate could not be easily vibrated and the low-pitched sound range was hard to reproduce.

Therefore, as shown in the piezo-electric speakers 1 to 4, in order to reproduce sounds from a high-pitched sound range to a low-pitched sound range, even when the thickness of the piezo-electric vibration plates 15 to 18 are increased, the thickness of the piezo-electric vibration plates are thick at their central portions 15*a* to 18*a*, close to the piezo-electrical member 10, and gradually decreased toward the peripheries of the piezo-electric vibration plates (peripheral portions 15*b* and 16*b*). Alternatively, the thickness at the peripheries of the piezo-electric vibration plates are larger compared with those of the central portions 17*a* and 18*a* (peripheral portions 17*b* and 18*b*). Accordingly, the piezo-electric speakers 1 to 4 where excess vibrations such as the second-order vibration and the third-order vibration cannot be easily generated when a larger signal is applied and also the piezo-electric vibration plates 15 to 18 can vibrate as a whole. Also, the thickness of the portions of the piezo-electric vibration plates 15 to 18 connected to the piezo-electric member 10 (central portions 15*a* to 18*a*) are larger compared with those of the peripheral portions 15*b* to 18*b*, so that the vibration of the piezo-electric member 10 can be certainly propagated to the piezo-electric vibration plates 15 to 18.

In addition, when the thickness of the piezo-electric vibration plates 15 and 16 is decreased in proportion to the distance from the central portion 15*a* (the center of vibration of the piezo-electric member 10), the thinnest portions of the piezo-electric vibration plates 15 and 16 are at their peripheral ends. Thus, the piezo-electric vibration plates 15 and 16 can easily move up and down from the center toward their peripheral ends. This enables the piezo-electric vibration plates 15 and 16 to easily vibrate as a whole. Accordingly, the speakers 1–4 obtain a broad sound range from the high-pitched sound range to the low-pitched sound range even when a larger signal is applied.

Figure 5:
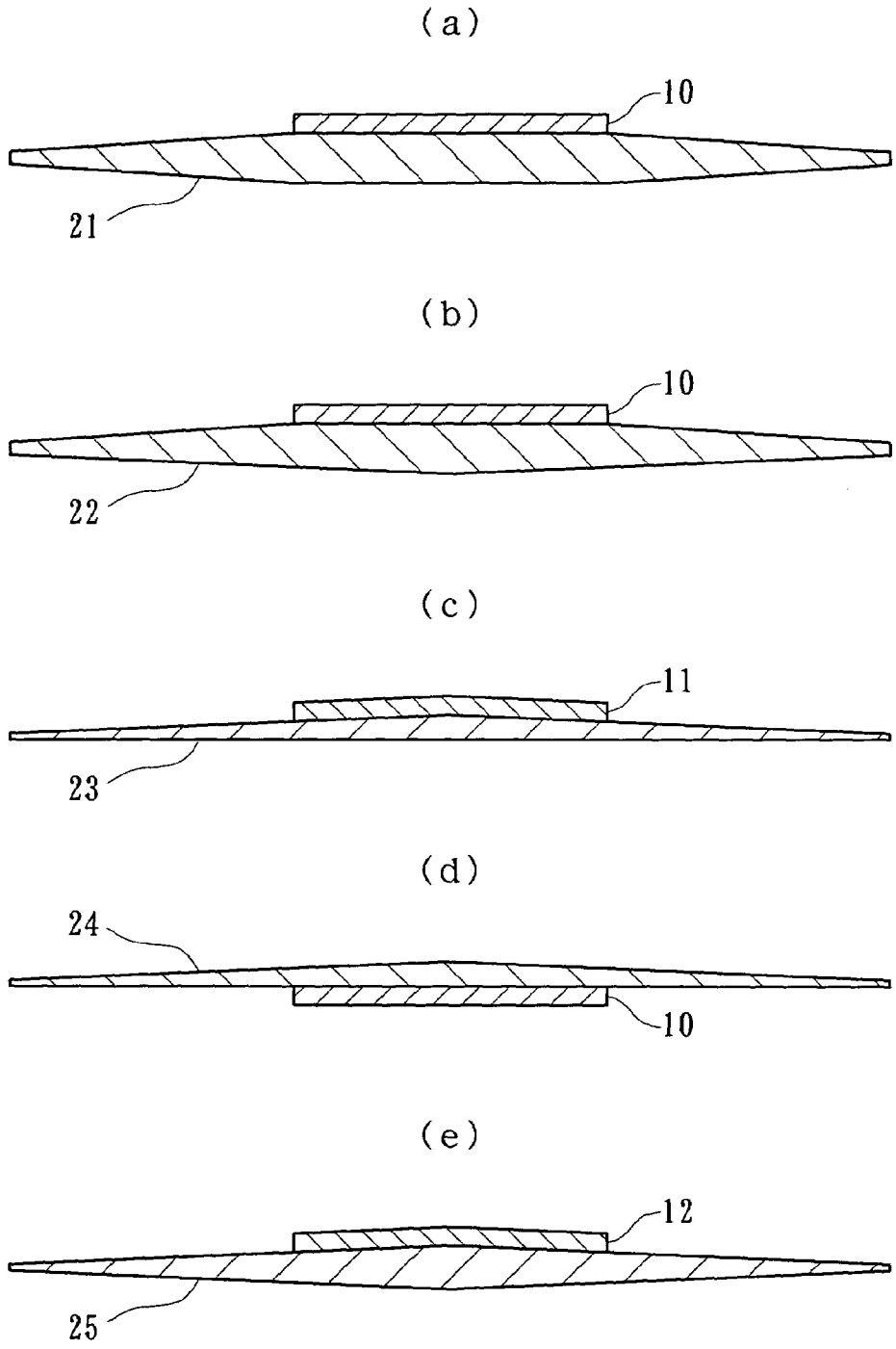
FIGS. 5(*a*) to 5(*e*) are cross-sectional views illustrating preferred embodiments of a piezo-electric speaker according to the present invention.

Note that, the shape relating to the thickness of the piezo-electric vibration plate is not limited to those shown in FIGS. 1(*a*) to 4(*b*). The shape may be of any type provided that a uniform broad-band sound pressure can be ensured. As a concrete example, some are ones shown in FIGS. 5(*a*) to 5(*e*). A piezo-electric vibration plate 21 of FIG. 5(*a*) is in the form of two piezo-electric vibration plates 15 and 15 adhered to each other. A piezo-electric vibration plate 22 of FIG. 5(*b*) is in the form of the piezo-electric vibration plate 15 adhered to a conical piezo-electric vibration plate. A piezo-electric vibration plate 23 of FIG. 5(*c*) includes a cone whose top is adhered to a piezo-electric member 11. A piezo-electric vibration plate 24 of FIG. 5(*d*) has a cone whose bottom is adhered to a piezo-electric member 12. A piezo-electric vibration plate 25 of FIG. 5(*e*) is in the form of two conical piezo-electric vibration plates adhered to each other.

Figure 6:
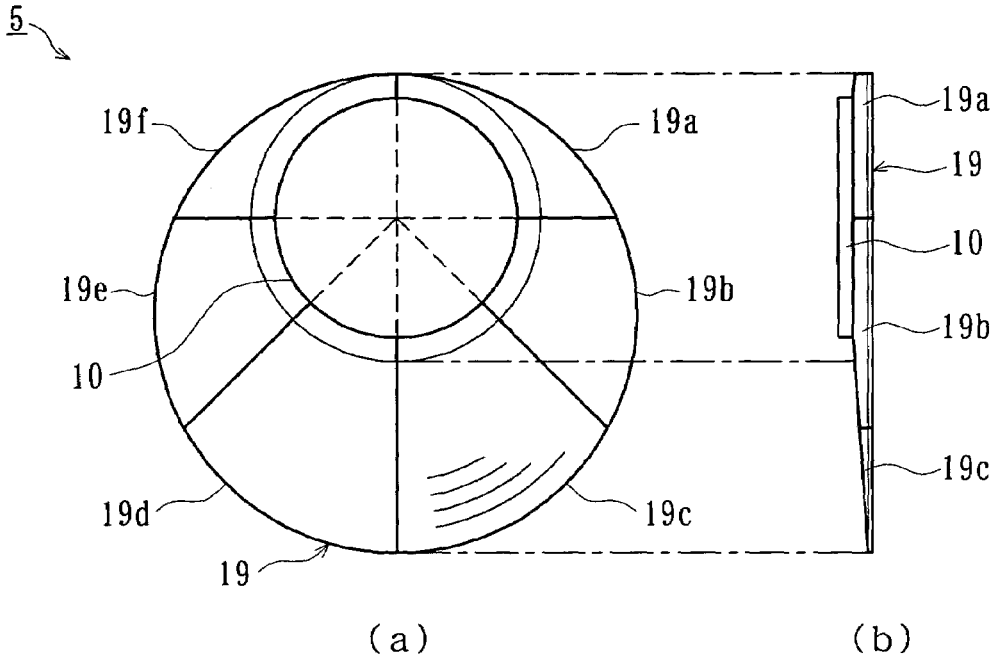
FIGS. 6(*a*) and 6(*b*) are a front view and a right side view, respectively, illustrating a fifth preferred embodiment of a piezo-electric speaker according to the present invention, with the center of a piezo-electric member deviated from a piezo-electric vibration plate.

FIGS. 6(*a*) and 6(*b*) are a front view and a right side view, respectively, illustrating a piezo-electric speaker 5. The center of the piezo-electric member 10 is positioned at a position deviated from the center of a piezo-electric vibration plate 19. In the piezo-electric speaker 5, the configuration of the piezo-electric member 10 and the piezo-electric vibration plate 19 are perfectly circular. The piezo-electric member 10 is adhered to the piezo-electric vibration plate 19 such that the center of the piezo-electric member 10 is positioned at a position slightly deviated in the upper right direction from the center of the piezo-electric vibration plate 19. The piezo-electric vibration plate 19 is divided into six parts by lines radiating from the center of vibration of the piezo-electric member 10. The divided piezo-electric vibration plates 19*a* to 19*f* are maintained perfectly circular by the piezo-electric member 10. Also, the piezo-electric vibration plate 19 is formed such that the thickness is gradually decreased toward the periphery of the piezo-electric vibration plate 19.

Figure 7:
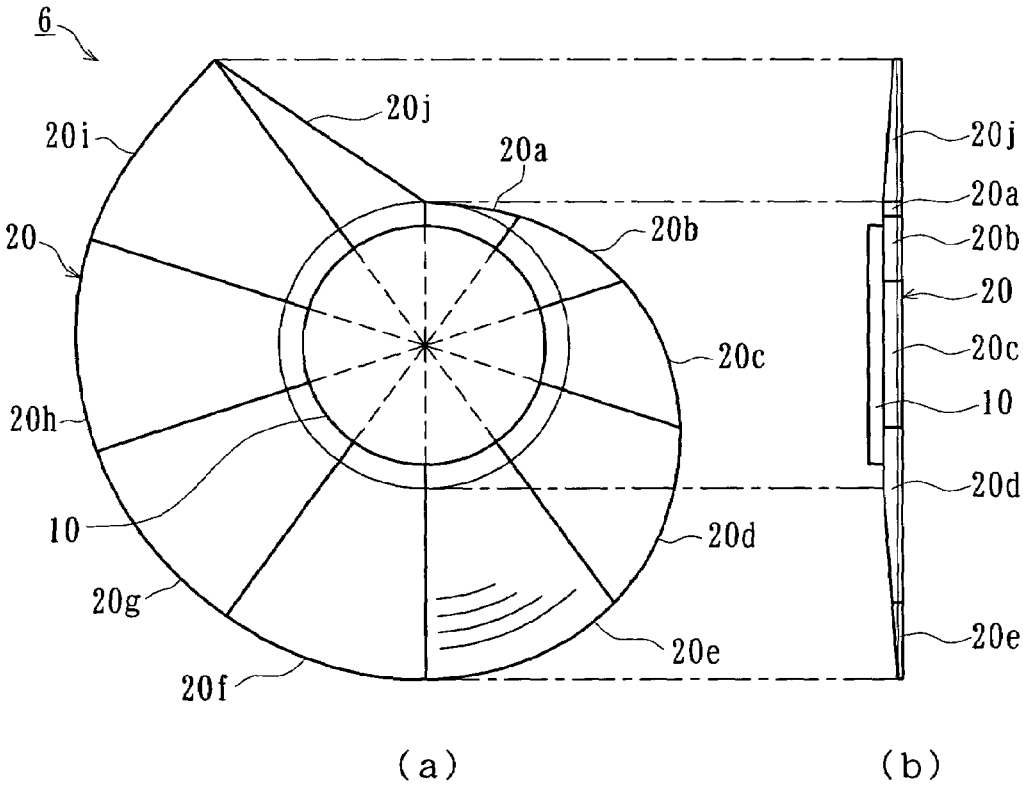
FIGS. 7(*a*) and 7(*b*) are a front view and a right side view, respectively, illustrating a sixth preferred embodiment of a piezo-electric speaker according to the present invention, with radii of eccentric arcs gradually increased.

FIGS. 7(*a*) and 7(*b*) are a front view and a right side view, respectively, illustrating a piezo-electric speaker 6. The periphery of the speaker 6 is formed by a gradually increasing radius. The piezo-electric speaker 6 includes piezo-electric vibration plates 20*a* to 20*i* with eccentric arcs. A piezo-electric vibration plate 20*j* forms an auxiliary movable region by connecting an outer end of a longest radius to an outer end of a shortest radius forming a predetermined depression angle. In more concrete terms for the radii of the piezo-electric vibration plates 20*a* to 20*i*, a radius of the piezo-electric vibration plate 20*a* is shortest and the radius gradually increases toward the piezo-electric vibration plate 20*i*. The piezo-electric vibration plates 20*a* to 20*j* are radially divided parts and are adhered in a disk form by the piezo-electric member 10. Also, the piezo-electric vibration plates 20*a* to 20*j* are formed such that their thickness gradually decrease toward their peripheries.

In the piezo-electric speakers 5 and 6, since the thickness of the piezo-electric vibration plates gradually decrease toward their peripheries the same way as in the piezo-electric speakers 1 and 2, it is possible to ensure uniform broad-band sound pressures. Furthermore, since a piezo-electric vibration plate is divided into several parts, distortion cannot be easily generated and vibration can be efficiently propagated from the center of the piezo-electric member 10 toward the peripheries of the piezo-electric vibration plates. Thus, it is possible to ensure uniform broad-band sound pressures. Also, in the piezo-electric speaker 6, since the distance from the center of vibration to the periphery of each of the vibration plates is not constant and many number of resonance points can be formed, it is possible to ensure uniform broad-band sound pressures without suffering a remarkable increase or decrease of the sound pressure at particular frequencies.

Figure 8:
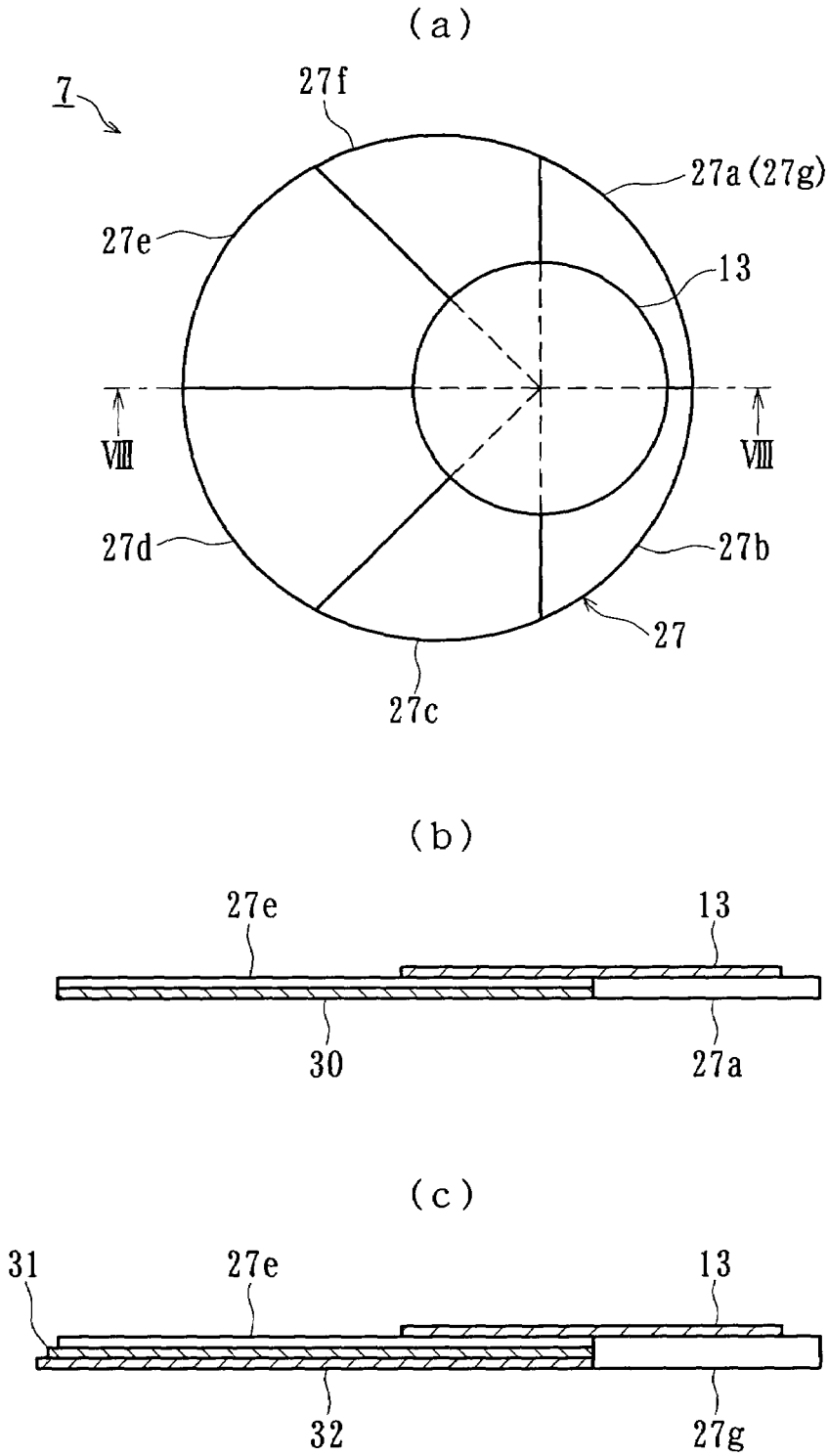
FIGS. 8(*a*) to 8(*c*) are a front view and cross-sectional views, respectively, illustrating a seventh preferred embodiment of a piezo-electric speaker according to the present invention, with the center of the piezo-electric member deviated from that of the piezo-electric vibration plate.

In a piezo-electric speaker 7 shown in FIGS. 8(*a*) and 8(*b*), the configurations of a piezo-electric member 13 and a piezo-electric vibration plate 27 are perfectly circular in the same way as in the piezo-electric speaker 5. The piezo-electric member 13 is adhered to the piezo-electric vibration plate 27 such that the center of the piezo-electric member 13 is positioned at a position slightly deviated in the right direction from the center of the piezo-electric vibration plate 27. The piezo-electric vibration plate 27 is divided into six parts by lines radiating from the center of vibration of the piezo-electric member 13. The divided piezo-electric vibration plates 27*a* to 27*f* are maintained perfectly circular by the piezo-electric member 13.

Also, the piezo-electric vibration plates 27*a* to 27*f* have different thickness with respect to each other (FIG. 8(*b*)). An uneven surface on an opposite side of the piezo-electric vibration plates adhered to the piezo-electric member 13 arises due to the variation of the thickness of the piezo-electric vibration plates 27*a* to 27*f*. An elastic member 30 is adhered to a thin piezo-electric vibration plate, such as 27*e*, in order to compensate for the thickness to flatten the surface. The thickness of the piezo-electric vibration plates are uniformed as explained above, which makes the strength of each of the vibration plates uniform. This improves the strength of the piezo-electric vibration plates. Also, since the thickness of the piezo-electric vibration plates 27*a* to 27*f* are changed individually, a vibration amplitude of a reproduced frequency by each of the piezo-electric vibration plates can be adjusted. This ensures a uniform broad-band sound pressure and reproducing a large acoustic signal.

Note that the elastic member 30 should be high in the modulus of elasticity and light in weight for an efficient propagation of acoustic vibrations. A material having a small internal loss for vibrations and a high vibration propagating speed of acoustic vibrations is suitable for the elastic member 30. In concrete terms, various materials such as elastic rubber, polyvinylchloride, cellulose fibrous paper, polyacetal fibrous sheet, carbon fiber sheet, Kepler fiber sheet, elastic polyethylene, elastic polyester, and the like can be employed for the elastic member 30.

Also, as shown in FIG. 8(*c*), the elastic member 30 may be structured by adhering a plurality of elastic members such as 31 and 32 to each other, instead of a single elastic member. Also, the peripheries of the elastic members 31 and 32 can be fan-shaped in a stair or in a slope.

Figure 9:
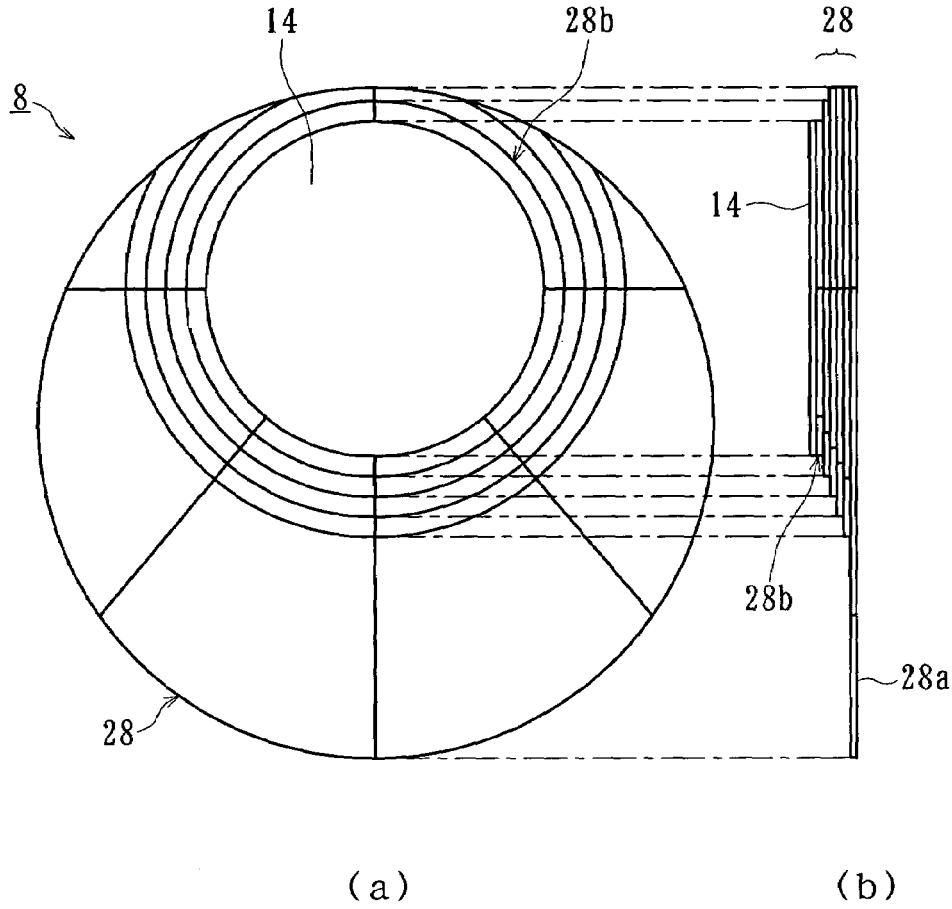
FIGS. 9(*a*) and 9(*b*) are a front view and a right side view, respectively, illustrating an eighth preferred embodiment of a piezo-electric speaker according to the present invention, with a plurality of piezo-electric vibration plates having radii different from each other superposed in a plane and a thickness of the piezo-electric speaker at a central portion and at a peripheral portion are different from each other.

As shown in FIGS. 9(*a*) and 9(*b*), the piezo-electric vibration plate may be constructed by laminating a plurality of disks having different sizes from each other into a single piezo-electric vibration plate. In FIGS. 9(*a*) and 9(*b*), a piezo-electric vibration plate 28 has six laminated disks with different diameters. The upper five disks are perfect circles and their centers coincide with each other. A lowermost disk 28*a* forms a perfect circle whose center is deviated from that of the upper five disks. A piezo-electric member 14 formed as a perfect circle is adhered to the top surface of an uppermost disk 28*b*. The piezo-electric member 14 is positioned so that the vibration centers of the piezo-electric member 14 and the disk 28*b* coincide with each other. In addition, the diameters of the disks are larger from the top to the bottom of the disks. Accordingly, the thickness of the piezo-electric vibration plate 28 is decreased according to the distance from the vibration center of the piezo-electric member 14. Also, the piezo-electric vibration plate 28 has six slits radiating from the vibration center of the piezo-electric member 14.

Figure 10:
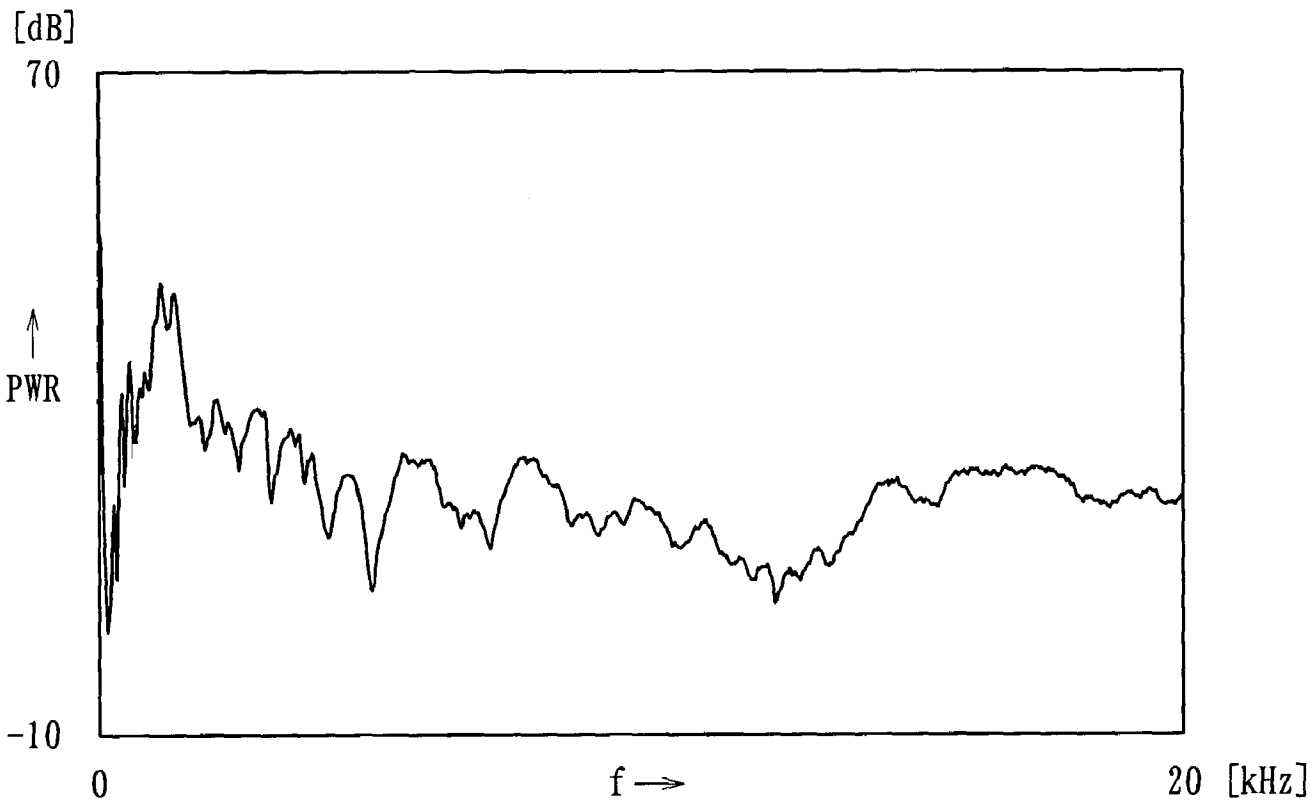
FIG. 10 is a graph illustrating the sound pressure characteristics of the piezo-electric speaker shown in FIGS. 9(*a*) and 9(*b*).

FIG. 10 is a graph illustrating the sound pressure characteristics of the piezo-electric speaker 8 shown in FIGS. 9(*a*) and 9(*b*). In the piezo-electric speaker 8, the diameter of the disk 28*a* is 100 mm and the diameters of the other disks from the top to the bottom are 50 mm, 56 mm, 62 mm, 68 mm and 74 mm. Each of the disks is made of stainless steel having a thickness of 0.1 mm. The diameter of the piezo-electric member 14 is 50 mm. As is obvious from FIG. 10, the piezo-electric speaker 8 has the sound pressure characteristics of a uniform broad-band. When compared to a prior art piezo-electric speaker, where it is difficult to ensure a uniform broad-band sound pressure, since the thickness of the piezo-electric vibration plate 28 is changed in accordance with the distance from the vibration center of the piezo-electric member 14, the amplitude of vibration is adjusted in accordance with the distance, thus obviously ensuring a uniform broad-band sound pressure.

The piezo-electric speaker 8 shown in FIGS. 9(*a*) and 9(*b*) has a plurality of disks with different radii superimposed onto each other. This easily varies the thickness of the piezo-electric vibration plate 28. In addition, the thickness of each of the disks is varied, thus easily realizing an optimum configuration of the piezo-electric vibration plate using an arbitrary combination.

According to the first preferred embodiment, since the thickness of the piezo-electric vibration plate is changed in accordance with the distance from the vibration center of the piezo-electric member, the amplitude of vibration can be adjusted in accordance with the distance. This ensures a uniform broad-band sound pressure and reproduces a large acoustic signal.

According to the second preferred embodiment, since the thickness of the piezo-electric vibration plate is decreased in proportion to the distance from the vibration center of the piezo-electric member, the piezo-electric vibration plate can easily vibrate from the center of the piezo-electric vibration plate toward the periphery. This easily enables the piezo-electric vibration plate to vibrate as a whole, and ensures a uniform broad-band sound pressure.

According to the third preferred embodiment, since the thickness of the piezo-electric vibration plate is uniform at a periphery of a portion connected to the piezo-electric member, the piezo-electric vibration plate can uniformly receive the vibration of the piezo-electric member. This ensures a uniform broad-band sound pressure.

According to the fourth preferred embodiment, since the thickness of the piezo-electric vibration plate is smaller at the periphery of the portion connected to the piezo-electric member than that of the portion connected to the piezo-electric member, the piezo-electric vibration plate can easily vibrate due to the small thickness while certainly receiving the vibration of the piezo-electric member. This ensures a uniform broad-band sound pressure.

According to the fifth preferred embodiment, since the piezo-electric vibration plate is divided into several arbitrary configurations and connected by the piezo-electric member, distortion is hardly generated. This ensures a further uniform broad-band sound pressure.

According to the sixth preferred embodiment, since the thickness of each of the piezo-electric vibration plates divided into arbitrary configurations varies, a vibration amplitude of a reproduced frequency of each of the piezo-electric vibration plates can be adjusted. This easily ensures uniform broad-band sound pressures and reproduces a large acoustic signal.

According to the seventh preferred embodiment, since the elastic member is adhered to each of the piezo-electric vibration plates to provide a uniform thickness of each of the piezo-electric vibration plates, the strengths of the vibration plates can be uniform. This improves the strength of the piezo-electric vibration plates.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A piezo-electric speaker comprising:

a piezo-electric member for generating a vibration in accordance with an applied electric signal; and a piezo-electric vibration plate adhered to said piezo-electric member for converting said vibration to sound, said piezo-electric plate being radially divided into a plurality of plate members by lines radiating from substantially the center of the piezo-electric member and each plate member adhered to said piezo-electric member wherein thickness of said piezo-electric vibration plate members are changed in accordance with the distance from the vibration center of said piezo-electric member.

2. The piezo-electric speaker according to claim 1, wherein the thickness of said piezo-electric vibration plate is decreased in proportion to the distance from the vibration center of said piezo-electric member.

3. The piezo-electric speaker according to claim 1, wherein the thickness of said piezo-electric vibration plate is uniform at a periphery of a portion connected to said piezo-electric member.

4. The piezo-electric speaker according to claim 1, wherein the thickness of said piezo-electric vibration plate is smaller at a periphery of a portion connected to said piezo-electric member than that of said portion connected to said piezo-electric member.

5. The piezo-electric speaker according to claim 1, wherein said piezo-electric vibration plate members have arbitrary configurations and are connected by said piezo-electric member.

6. A piezo-electric speaker comprising:

a piezo-electric member for generating a vibration in accordance with an applied electric signal; and a piezo-electric vibration plate adhered to said piezo-electric member for convening said vibration to sound, wherein said piezo-electric vibration plate is radially divided into several arbitrary parts by lines radiating from substantially the center of the piezo-electric member and the thickness of each of said several arbitrary parts of said piezo-electric vibration plates is different from each other.

7. The piezo-electric speaker according to claim 6, wherein an elastic member is adhered to a surface of each of said piezo-electric vibration parts on an opposite side of said piezo-electric member to provide a uniform thickness of each of said piezo-electric vibration plates.

8. A piezo-electric speaker comprising:

a piezo-electric member for generating a vibration in accordance with an applied electric signal; and a piezo-electric vibration plate adhered to said piezo-electric member for convening said vibration to sound, said piezo-electric plate being radially divided into a plurality of plate members by lines radiating from a point on the piezo-electric member and each plate member adhered to said piezo-electric member wherein thickness of said piezo-electric vibration plate members are changed in accordance with the distance from the vibration center of said piezo-electric member.

9. The piezo-electric speaker according to claim 8, wherein the thickness of said piezo-electric vibration plate is decreased in proportion to the distance from the vibration center of said piezo-electric member.

10. The piezo-electric speaker according to claim 8, wherein the thickness of said piezo-electric vibration plate is uniform at a periphery of a portion connected to said piezo-electric member.

11. The piezo-electric speaker according to claim 8, wherein the thickness of said piezo-electric vibration plate is smaller at a periphery of a portion connected to said piezo-electric member than that of said portion connected to said piezo-electric member.

12. The piezo-electric speaker according to claim 8, wherein said piezo-electric vibration plate members have arbitrary configurations and are connected by said piezo-electric member.

* * * * *